US006363715B1

(12) United States Patent
Bidner et al.

(10) Patent No.: US 6,363,715 B1
(45) Date of Patent: Apr. 2, 2002

(54) AIR/FUEL RATIO CONTROL RESPONSIVE TO CATALYST WINDOW LOCATOR

(75) Inventors: David Karl Bidner, Livonia; Gopichandra Sumilla, West Bloomfield; Imad Hassan Makki, Dearborn Heights; James Michael Kerns, Trenton; Stephen B. Smith, Livonia, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/561,643

(22) Filed: May 2, 2000

(51) Int. Cl.[7] ..... F01N 3/00

(52) U.S. Cl. ..... 60/285; 60/274; 60/277; 60/276

(58) Field of Search ..... 60/274, 277, 285, 60/301, 276

(56) References Cited

U.S. PATENT DOCUMENTS

| | | | | |
|---|---|---|---|---|
| 4,024,706 A | | 5/1977 | Adawi et al. | |
| 4,953,351 A | | 9/1990 | Motz et al. | |
| 5,255,512 A | | 10/1993 | Hamburg et al. | |
| 5,282,360 A | | 2/1994 | Hamburg et al. | |
| 5,341,643 A | * | 8/1994 | Hamburg et al. | 60/277 |
| 5,375,415 A | | 12/1994 | Hamburg et al. | |
| 5,383,333 A | | 1/1995 | Logothetis et al. | |
| 5,426,934 A | * | 6/1995 | Hunt et al. | 60/277 |
| 5,452,576 A | * | 9/1995 | Hamburg et al. | 60/277 |
| 5,537,816 A | | 7/1996 | Ridgway et al. | |
| 5,595,060 A | * | 1/1997 | Togai et al. | 60/277 |
| 5,657,625 A | * | 8/1997 | Koga et al. | 60/285 |
| 5,946,905 A | | 9/1999 | Bouwman | |
| 6,012,282 A | * | 1/2000 | Kato et al. | 60/277 |
| 6,076,348 A | * | 6/2000 | Falandino et al. | 60/277 |
| 6,145,305 A | * | 11/2000 | Itou et al. | 60/277 |
| 6,148,612 A | * | 11/2000 | Yamashita et al. | 60/277 |

* cited by examiner

*Primary Examiner*—Thomas Denion
*Assistant Examiner*—Diem Tran
(74) *Attorney, Agent, or Firm*—Allan J. Lippa

(57) ABSTRACT

An air/fuel control method for an engine including a $NO_x$ sensor in operative relationship to a catalytic converter. The method comprises the steps of providing a base fuel signal related to a quantity of air inducted into the engine and generating a bias signal for biasing the base fuel signal towards a leaner air/fuel ratio. The output of the $NO_x$ sensor is monitored to detect a predetermined exhaust gas $NO_x$ value representing a predefined $NO_x$ conversion efficiency. The base fuel signal is then modified as a function of the bias signal corresponding to the predetermined exhaust gas $NO_x$ value to maintain the catalytic converter within a desired efficiency range. In one aspect of the invention, the process of detecting the edge of the $NO_x$ conversion efficiency window is executed at predetermined time periods measured by the distance the vehicle traveled, or the elapsed time since last base fuel value modification.

11 Claims, 3 Drawing Sheets

AIR/FUEL RATIO CONTROL RESPONSIVE TO CATALYST WINDOW LOCATOR

BACKGROUND OF THE INVENTION

1. Field of the Invention

The present invention relates to an air/fuel ratio control system for an internal combustion engine coupled to a catalytic converter.

2. Description of the Related Art

Three-way catalytic converters (TWC) are commonly used to remove pollutants such as $NO_x$, HC, and CO components in the exhaust gas of an internal combustion engine. $NO_x$ is removed from the exhaust gas by reduction using the CO, HC and $H_2$ in the exhaust gas. There is also typically enough $O_2$ present to oxidize the CO and HC. Generally, however, the catalyst used in such converters is able to remove the pollutants from the exhaust gas simultaneously only when the air/fuel ratio of the exhaust gas is kept in a narrow range near the stoichiometric air/fuel ratio.

FIG. 1 shows the conversion efficiency of a typical TWC as a function of measured exhaust gas air/fuel ratio. As can be seen in FIG. 1, TWCs require that the air/fuel ratio of the engine be held in a relatively narrow range, such as window 10, to assure high conversion efficiencies. Therefore, in order to reduce undesirable emissions within the exhaust gas, it is important to keep the air/fuel ratio of the engine in the region where the TWC has high efficiency. Typically, this is near the stoichiometric air/fuel ratio or at a predetermined offset near stoichiometric. Component drifting or aging can result in an altered air/fuel ratio and, hence, less than optimum efficiency of the TWC.

SUMMARY OF THE INVENTION

An object of the invention herein is to provide a method of locating the peak TWC efficiency window. Another object is to maintain engine air/fuel operation within the peak efficiency window of a catalytic converter.

An air/fuel control method for an engine including a $NO_x$ sensor in operative relationship to a catalytic converter. The method comprises the steps of providing a base fuel signal related to a quantity of air inducted into the engine and generating a bias signal for biasing the base fuel signal towards a leaner air/fuel ratio. The output of the $NO_x$ sensor is monitored to detect a predetermined exhaust gas $NO_x$ value representing a predefined $NO_x$ conversion efficiency. The base fuel signal is then modified as a function of the bias signal corresponding to the predetermined exhaust gas $NO_x$ value to maintain the catalytic converter within a desired efficiency range. In one aspect of the invention, the process of detecting the edge of the $NO_x$ conversion efficiency window is executed at predetermined time periods measured by the distance the vehicle has traveled, or the elapsed time since last base fuel value modification.

One advantage of the present invention is that it suppresses fluctuation in the air/fuel ratio. Another advantage is that it improves the efficiency of the catalytic converter.

Other objects and advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF THE INVENTION

Figure 1:
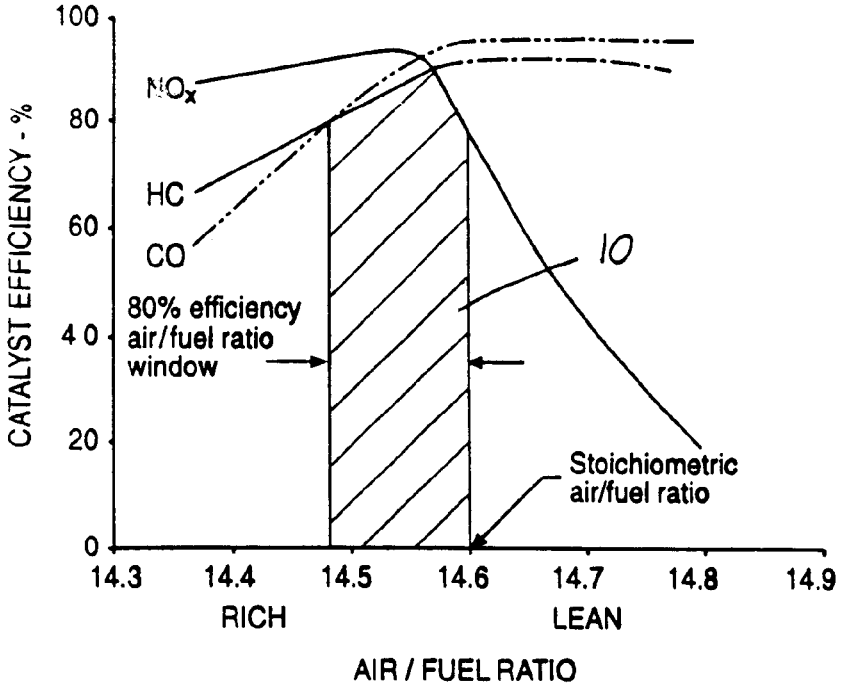
FIG. 1 is a graph of the conversion efficiency of a typical TWC as a function of measured exhaust gas air/fuel ratio.

An example of an engine and associated control system incorporating a $NO_x$ sensor for fuel control will now be discussed. Fuel delivery system 11, shown in FIG. 2 of an automotive internal combustion engine 13 is controlled by controller 15, such as an EEC or PCM. In general terms, controller 15 controls engine air/fuel ratio in response to a feedback variable derived from the output of an upstream exhaust gas oxygen sensor 54. Feedback from a second downstream rear exhaust gas oxygen sensor 55 is used to bias the feedback variable to provide improved air/fuel control. Concurrently, as described herein with reference to FIG. 4, controller 15 provides air/fuel bias in response to the output of the $NO_x$ sensor 100. Sensor 100 is a $NO_x$ sensor having an output corresponding to the air/fuel ratio of the engine 13. As described later herein, the air/fuel biasing forces engine air/fuel operation to be within the peak efficiency window of the three-way (HC, CO, $NO_x$ ) catalytic converter 52.

Figure 2:
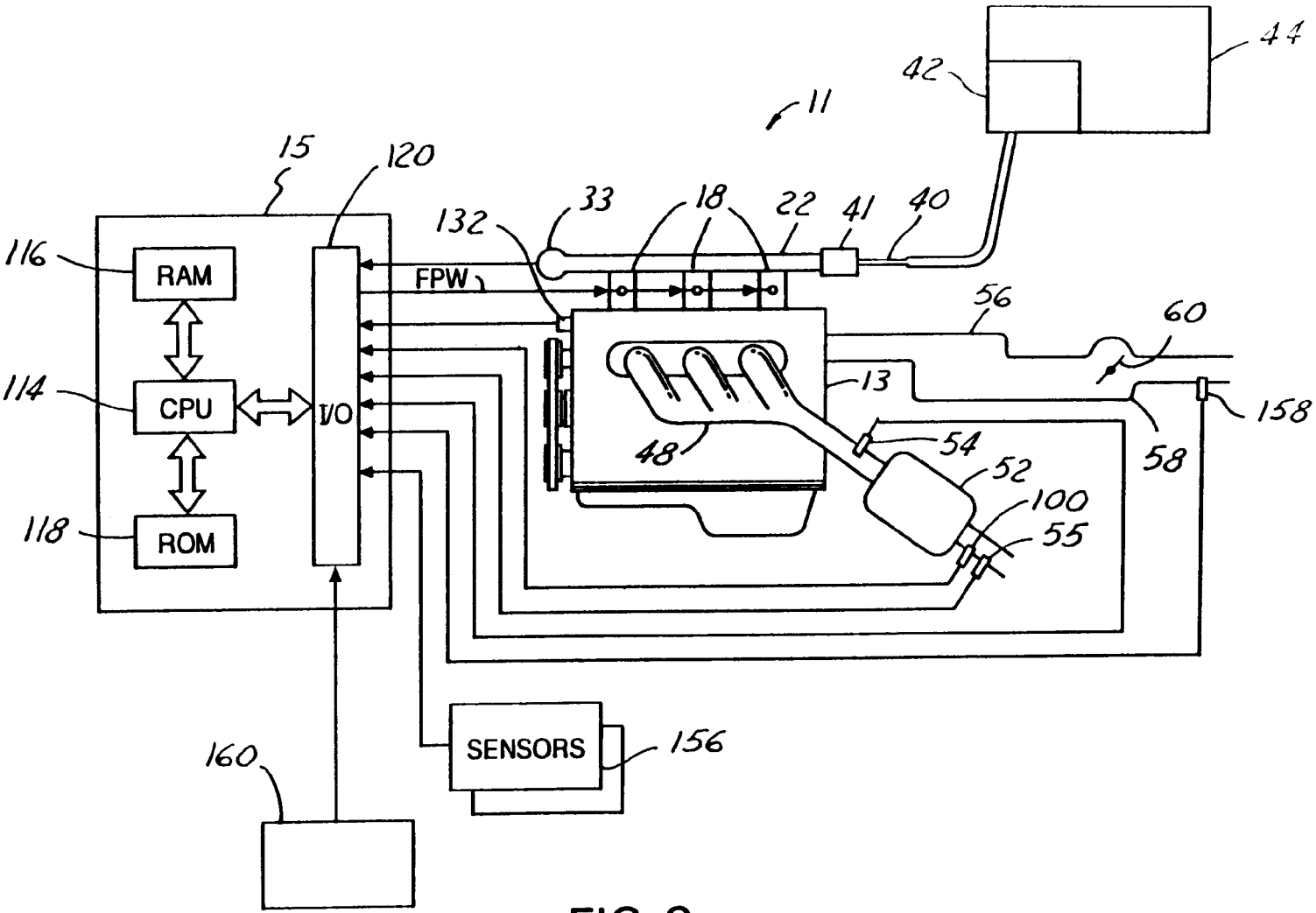
FIG. 2 is a block diagram of an engine system where the present invention may be advantageously used.

Continuing with FIG. 2, engine 13 includes fuel injectors 18, which are in fluid communication with fuel rail 22 to inject fuel into the cylinders (not shown) of engine 13, and temperature sensor 132 for sensing temperature of engine 13. Fuel delivery system 11 has fuel rail 22, fuel rail pressure sensor 33 connected to fuel rail 22, fuel line 40 coupled to fuel rail 22 via coupling 41, and fuel delivery means 42, which is housed within fuel tank 44, to selectively deliver fuel to fuel rail 22 via fuel line 40.

Engine 13 also includes exhaust manifold 48 coupled to exhaust ports of the engine (not shown). TWC 52 is coupled to exhaust manifold 48. An exhaust gas oxygen sensor 54 (i.e., a wide range exhaust gas oxygen sensor) is positioned upstream of the catalytic converter 52 in exhaust manifold 48. An additional EGO sensor 55 is located downstream of the catalyst 52. Engine 13 further includes intake manifold 56 coupled to intake ports of the engine (not shown). Intake manifold 56 is also coupled to throttle body 58 having throttle plate 60 therein.

Controller 15 is shown as a conventional microcontroller including: a CPU 114, random access memory 116 (RAM), computer storage medium (ROM) 118 having a computer readable code encoded therein, which is an electronically programmable chip in this example, and input/output (I/O) bus 120. Controller 15 controls engine 13 by receiving various inputs through I/O bus 120 such as fuel pressure in fuel delivery system 11, as sensed by pressure sensor 33; relative exhaust air/fuel ratio as sensed by exhaust gas oxygen sensors 54 and 55; temperature of engine 13 as sensed by temperature sensor 132; measurement of inducted mass airflow (MAF) from mass airflow sensor 158; speed of engine (RPM) from engine speed sensor 160; relative exhaust gas $NO_x$ concentration from $NO_x$ sensor 100; and various other sensors 156.

Controller 15 also generates various outputs through I/O bus 120 to actuate the various components of the engine control system. Such components include fuel injectors 18 and fuel delivery means 42. It should be noted that the fuel may be liquid fuel, in which case fuel delivery means 42 is an electronic fuel pump and the delivery of fuel is in proportion to the pulse width of signal FPW from controller 15.

Fuel delivery control means 42, upon demand from engine 13 and under control of controller 15, pumps fuel from fuel tank 44 through fuel line 40, and into pressure fuel rail 22 for distribution to the fuel injectors during conventional operation. Controller 15 controls fuel injectors 18 to maintain a desired air/fuel ratio in response to exhaust gas oxygen sensor 54. EGO sensor 54 provides a signal to the controller 15 which converts the signal into a two-state signal (EGOs). A high voltage state of signal EGOs indicates exhaust gases are rich of a reference air/fuel ratio and a low voltage state of the converted signal indicates exhaust gases are lean of the reference air/fuel ratio. Typically, the reference air/fuel ratio or switch point of EGO sensor 54 should be at stoichiometry, and stoichiometry should correspond to the peak efficiency window of the average catalytic converter. However, due to manufacturing processes and component aging, the switch point of EGO sensor 54 may not be at stoichiometry. To correct for this, a correction term or offset is applied to the switch voltage of the EGO sensor 54. Further, the peak efficiency window of TWC 52 may not be at stoichiometry. Therefore, it may be desirable to offset the switch voltage of the EGO sensor(s) to maintain the TWC 52 in the peak efficiency window.

Figure 3:
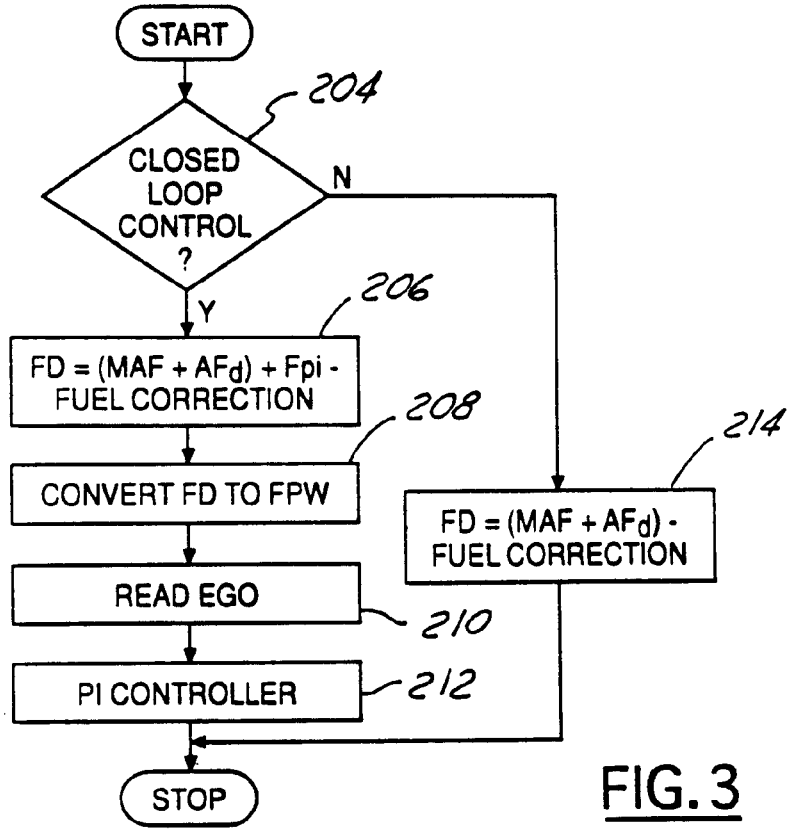
FIG. 3 is a logic flow diagram representing one method of controlling the air/fuel ratio feedback control system of FIG. 2.

There are many methods of controlling engine air/fuel ratio with the use of one or more EGO sensors. One example of a method of controlling the air/fuel ratio of the engine 13 with the exhaust gas oxygen sensors 54 and 55 will now be discussed with respect to FIG. 3. Referring now to FIG. 3, a flowchart of a routine performed by controller 15 to control the fuel pulse width signal (FPW) is shown. Fuel pulse width signal (FPW) is the signal sent by controller 15 to fuel injectors 18 to deliver the desired quantity of fuel to engine 13. A determination is first made whether closed-loop air/fuel control is to be commenced (step 204) by monitoring engine operating conditions such as temperature. When closed-loop control commences, the desired fuel signal FD is calculated as a function of MAF, the desired air/fuel ratio term Afd, a feedback correction term Fpi, and a fuel correction term (FC) as shown in step 206. In step 208, the signal FD is converted to fuel pulse width signal FPW representing a time to actuate fuel injectors 18. In step 210, signal EGO is read from sensor 54 and subsequently processed in a proportional plus integral controller in step 212, to achieve the desired air/fuel ratio.

When open-loop control is used, the signal FD is calculated by adding MAF to the desired air/fuel ratio term Afd less any fuel correction (FC) as shown in step 214.

Figure 4:
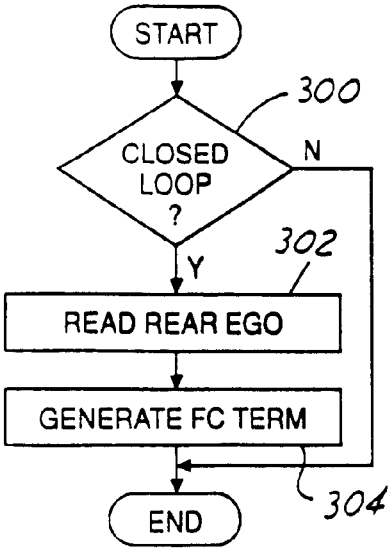
FIG. 4 is a logic flow diagram of one embodiment of the fuel correction term routine for use in the system of FIG. 3.

Referring now to FIG. 4, there is shown one embodiment of a logic routine for generating the fuel correction term of steps 206 and 214 of FIG. 3. Continuing with FIG. 4, it is determined whether the engine is operating under closed-loop fuel control in step 300. If so, the downstream or rear EGO sensor 55 output is read in step 302. In step 304, the fuel correction (FC) term is generated. This is accomplished by performing proportional-integral-differential control on the EGO sensor output voltage. The error term used by the controller is the EGO output voltage, less any calibration offset, plus any correction derived from the $NO_x$ sensor output as described below. Alternatively, integral only control could be used to generate the FC term. This FC term is then output to the primary air/fuel control scheme such as that shown in FIG. 3.

Figure 5:
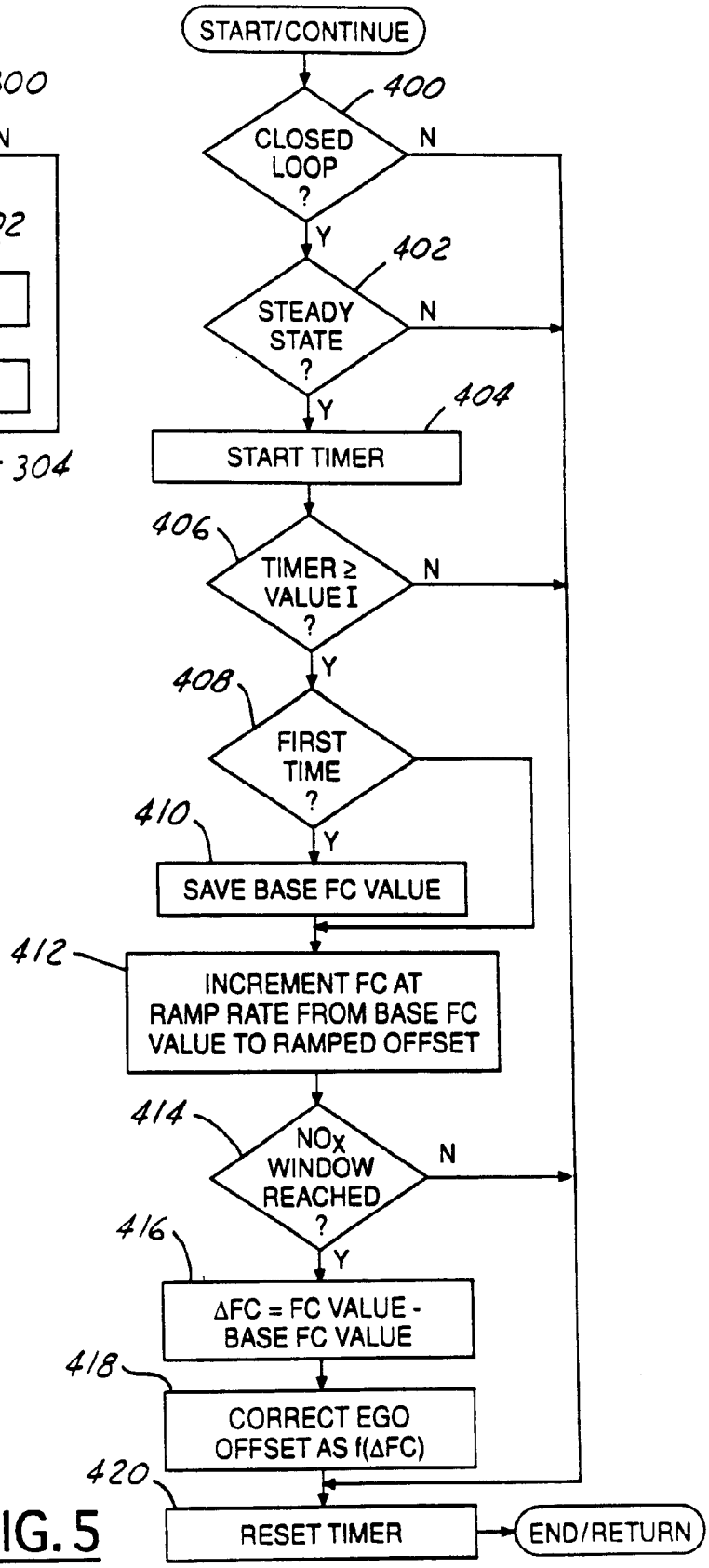
FIG. 5 is a logic flow diagram of one embodiment of the catalyst window locator routine according to the present invention.

A logic routine will now be described with particular reference to FIG. 5 for biasing the air/fuel control through the variable FC so that engine air/fuel operation is maintained within the peak efficiency window of converter 52.

In step 400, the routine determines if the engine is operating under closed-loop air/fuel control. Further, in step 402, it is determined whether the engine is operating under steady state conditions. If these conditions are satisfied, a timer is started in step 404. The timer is used to dictate how often the $NO_x$ window detection routine as described below is executed. This routine is only periodically executed because it is an intrusive test. The timer may relate to time or distance that the vehicle is operating under closed-loop, steady-state conditions. The timer is compared against a predetermined value (VALUE 1) in step 406 which, again, may be minutes or miles since the last routine execution.

Instead of, or in addition to, the timer, the $NO_x$ window detection routine may be executed at each start-up, for example, after warmed-up conditions are satisfied.

The first time the $NO_x$ window detection routine is executed in step 408, the base FC value is stored in step 410. As discussed, with respect to FIGS. 3 and 4, FC is the fuel correction term which is used by the primary air/fuel ratio control scheme.

The routine then continues to step 412, where the FC control output is incremented at a predetermined rate (RAMP RATE) from the base FC value to a desired ramp value (OFFSET). The FC value is incremented to bias the air/fuel control towards a leaner air/fuel ratio. The ramp rate is set such that the system delay between the change in air/fuel ratio and the detection of the change by the downstream EGO and $NO_x$ sensors correlates. In other words, if the FC value is incremented too quickly, it is difficult to correlate the $NO_x$ window edge with the FC value responsible for reaching the edge of the window.

After each FC value increment, the $NO_x$ sensor output is monitored to determine whether the edge of the efficiency window has been reached. This is accomplished by comparing the $NO_x$ sensor output to a predetermined value corresponding to the desired efficiency defining the edge of the window. The routine is continuously executed until the window edge has been reached.

Once the edge of the $NO_x$ efficiency window has been detected, the change in FC value necessary to reach the window edge is determined in step 416. This value ($\Delta$FC) is then used to correct the downstream EGO control set voltage to maintain the air/fuel ratio within a range such that the $NO_x$ conversion efficiency is maximized. This is accomplished by a calibrateable lookup table wherein the number of increments to reach the window edge is correlated to the EGO voltage switch point to maximize TWC efficiency. The resulting $NO_x$ sensor TWC window correction term is then used as described above to generate the FC term which, in turn, is used by the primary air/fuel control scheme.

Alternatively, the $NO_x$ sensor TWC window correction term could be applied directly to the primary air/fuel control scheme as the FC value used to modify the base fuel signal.

In step 420, the timer is reset and the routine is ended or continued as desired.

From the foregoing, it can be seen that there has been brought to the art a new and improved air/fuel ratio control scheme which maintains the air/fuel ratio such that the catalytic converter operates near peak efficiency. While the invention has been described in connection with one or more embodiments, it should be understood that it is not limited to those embodiments. On the contrary, the invention covers all alternatives, modifications, and equivalents as may be included within the spirit and scope of the appended claims.

What is claimed is:

1. An air/fuel control method for an engine including a $NO_x$ sensor positioned in operative relationship to a catalytic converter, the method comprising the steps of:

providing a base fuel signal related to a quantity of air inducted into the engine;

generating a bias signal for biasing said base fuel signal towards a leaner air/fuel ratio;

monitoring an output of said $NO_x$ sensor to detect a predetermined exhaust gas $NO_x$ value representing a minimum desired $NO_x$ conversion efficiency; and modifying said base fuel signal as a function of said bias signal corresponding to said predetermined exhaust gas $NO_x$ value to maintain the air/fuel ratio at a value corresponding to a maximum desired $NO_x$ conversion efficiency.

2. A method of maintaining the conversion efficiency of a catalytic converter within a predetermined efficiency window, said catalytic converter being associated with a vehicle having an engine associated with an exhaust gas oxygen sensor and $NO_x$ sensor, the method comprising the steps of:

determining a base fuel signal related to a quantity of air inducted into the engine by said exhaust gas oxygen sensor;

iteratively perturbing said base fuel signal by a bias signal until said $NO_x$ sensor indicates a predetermined $NO_x$ value corresponding to a minimum desired $NO_x$ conversion efficiency level; and modifying said base fuel signal as a function of said bias signal corresponding to said predetermined exhaust gas $NO_x$ value to maintain the air/fuel ratio at a value corresponding to a maximum desired $NO_x$ conversion efficiency.

3. The method of claim 2 wherein the step of iteratively perturbing said base fuel signal by a bias signal includes the step of perturbing said base fuel signal by said bias signal towards a leaner air/fuel ratio.

4. The method of claim 2 wherein the step of iteratively perturbing said base signal by a bias signal includes the step of perturbing said base fuel signal by a bias signal at a desired ramp rate.

5. The method of claim 2 further comprising the steps of activating a counter representative of the delay since the last modification of said base fuel signal.

6. The method of claim 5 wherein the step of activating a counter includes the steps of storing the distance traveled by said vehicle since the last modification of said base fuel signal.

7. The method of claim 5 wherein the step of activating a counter includes the steps of determining the total time of engine operation since the last modification of said base fuel signal.

8. An air/fuel ratio control system for a vehicle including an internal combustion engine having an associated fuel delivery system and catalytic converter, the system comprising:

an exhaust sensor for indicating an air/fuel ratio of exhaust gas exiting the engine;

a $NO_x$ sensor for indicating the $NO_x$ conversion efficiency of said catalytic converter; and a controller including a processor and associated memory programmed to perform the following steps:

provide a base fuel signal related to a quantity of air inducted into the engine; generate a bias signal for biasing said base fuel signal towards a leaner air/fuel ratio; monitor said $NO_x$ sensor to detect a minimum desired $NO_x$ conversion efficiency associated with said bias signal; modify said base fuel signal as a function of said bias signal to maintain the air/fuel ratio at a value corresponding to a maximum desired $NO_x$ conversion efficiency; and generate an actuation signal to cause said fuel delivery system to deliver said modified base fuel signal to said engine.

9. An air/fuel ratio control system for a vehicle including an internal combustion engine having an associated fuel delivery system and catalytic converter, the system comprising:

an exhaust sensor for indicating an air/fuel ratio of exhaust gas exiting the engine;

a $NO_x$ sensor for indicating the $NO_x$ conversion efficiency of said catalytic converter;

a controller including a processor and associated memory programmed to perform the following steps:

provide a base fuel signal related to a quantity of air inducted into the engine; generate a bias signal for biasing said base fuel signal towards a leaner air/fuel ratio; monitor said $NO_x$ sensor to detect a predefined $NO_x$ conversion efficiency associated with said bias signal; modify said base fuel signal as a function of said bias signal to maintain said catalytic converter within a desired efficiency range; and generate an actuation signal to cause said fuel delivery system to deliver said modified base fuel signal to said engine; and a counter for determining the delay since the last modification of said base fuel signal.

10. The control system of claim 9 wherein said counter monitors the distance traveled by said vehicle since the last modification of said base fuel signal.

11. The control system of claim 9 wherein said counter determines the total time of engine operation since the last modification of said base fuel signal.

* * * * *